US005882070A

United States Patent [19]

Genn

[11] Patent Number: 5,882,070

[45] Date of Patent: Mar. 16, 1999

[54] PORTABLE EASEL AND SEAT FOR ARTISTS

[76] Inventor: Robert R. Genn, 12711 Beckett Road, Surrey, British Columbia, Canada, V4A 2W9

[21] Appl. No.: 953,835

[22] Filed: Oct. 13, 1997

[51] Int. Cl.[6] ..... A47B 39/00

[52] U.S. Cl. ..... 297/174; 297/156; 297/135; 312/231; 312/235.5; 248/461; 248/463; 248/464

[58] Field of Search ..... 297/174, 156, 297/188.01, 188.08, 188.13, 135; 312/230, 231, 233, 235.5, 244, 351.6; 248/451, 460, 461, 462, 463, 464

[56] References Cited

U.S. PATENT DOCUMENTS

| | | | |
|---|---|---|---|
| 0,375,953 | 1/1888 | Richter . | |
| 3,399,925 | 9/1968 | Levy | 297/156 |
| 3,907,360 | 9/1975 | Czarnowski | 297/156 |
| 4,076,348 | 2/1978 | Allison | 248/461 X |
| 4,134,614 | 1/1979 | Fielding, Sr. | 297/156 |
| 4,149,763 | 4/1979 | Delahaie | 312/231 |
| 4,482,185 | 11/1984 | Zoellner | 297/135 |
| 5,040,762 | 8/1991 | Potter | 248/460 |
| 5,219,142 | 6/1993 | Potter | 248/454 |
| 5,244,267 | 9/1993 | Fossier | 312/231 |
| 5,330,248 | 7/1994 | Smyly et al. | 297/174 |
| 5,399,009 | 3/1995 | Hiner | 312/231 |

FOREIGN PATENT DOCUMENTS

| | | | |
|---|---|---|---|
| 388617 | 9/1990 | European Pat. Off. | 312/235.5 |

*Primary Examiner*—Laurie K. Cranmer
*Attorney, Agent, or Firm*—Christie, Parker & Hale, LLP

[57] ABSTRACT

A portable easel and seat for artists is foldable into a compact unit and has wheels for pushing or towing to a site. The easel comprises a box having removable wheels mounted at a rear end, and two legs pivoted at the front end of the box, the legs extend down to a locked lowered position. A seat is provided at the rear end of the box with a folding back, and an easel frame with first pairs and second pairs of foldable arms pivoted together and to the front end of the box that can either be flat on the box in a folded position or open up to form an easel. Mounting strips are provided on the arms to support canvases or boards.

14 Claims, 4 Drawing Sheets

PORTABLE EASEL AND SEAT FOR ARTISTS

The present invention relates to a portable easel and more specifically to a combined easel and seat that is foldable into a compact unit.

FIELD OF THE INVENTION

Artists often set up easels in remote sites for painting landscapes and the like and in order to locate themselves for painting it is often necessary to carry an easel, a stool and all painting equipment, including canvases and boards, to the site. This generally involves a number of items that have to be carried and in some cases it may be necessary to make two trips to an artist's site from, for instance, a car.

DESCRIPTION OF REALTED ART INCLUDING INFORMATION DISCLOSED UNDER 37 CFR 1.97 AND 37 CFR 1.98

Various types of portable easels are available on the market. Some of these collapse or fold to a compact size so they are easy to carry. Also foldable stools and chairs are available. Some transportable easels such as that shown by Hiner in U.S. Pat. No. 5,399,009 is provided with wheels so that it can be pushed or towed to a site.

The idea of having a combined seat, easel and sunshade was disclosed by Richter in U.S. Pat. No. 375,953 which was patented in 1888. Richter shows a series of telescopic legs and braces, the assembly of which appears to be rather complex.

SUMMARY OF THE INVENTION

I have now found that I can provide a combined easel and seat assembly foldable into a substantially oblong-shaped box which has wheels at one end for ease of transporting and legs at the other end which fold down to support the box on the ground. The box has connections for attaching elongated members to connect the box to a bicycle so it may be towed. Compartments are provided in the box for canvases, boards, paints and the necessary artists' supplies. Therefore, the one assembly may be pushed or pulled to a site, and includes all that an artist requires. Thus, only one trip need be made to that site. Provision is made on the box, when in the open position, for mounting an umbrella or sunshade and the seat itself has a foldable backrest, thus making it more comfortable than a canvas stool which is frequently used by artists.

The easel has support strips on two easel arms for supporting a canvas or board at almost any height on the easel to suit the artist. A palette may be included in the box itself and provision is made on the easel arms for the palette to be held in slots. In one embodiment a storage compartment within the box permits 11"×14" canvases or boards with sufficient space in a different storage compartment for paints, liquids, brushes and other related materials.

The portable easel and seat can be towed behind a bicycle which makes it convenient for artists to cycle to sites. Alternatively, the wheels are removable so the assembly may be placed in the trunk of a car and then the wheels assembled and pulled to a site by handle which forms part of the support for the easel arms when raised.

In one embodiment the easel and seat assembly has a weather resistant finish, and a maul-stick is provided with a hook to fit over one of the support members on the easel arms.

The present invention provides a portable easel and seat assembly comprising: a substantially oblong-shaped box having two wheels removably mounted at a rear end of the box, and two legs pivoted from a pivot position at a front end of the box, the legs extending down to a locked lowered position, which together with the wheels, support the box in a plane substantially parallel to the ground; a seat at the rear end of the box; an easel frame with a first pair of substantially parallel arms linked together and with lower ends pivoted at the pivot position at the front end of the box, the first pair of arms supported in an upright position, and foldable to a first stored position on the top of the box, a second pair of substantially parallel arms, pivoted to upper ends of the first pair of arms, supported in an extended position substantially in line with the first pair of arms, and foldable to a second stored position within the first pair of arms, and mounting strips on the first pair of arms and the second pair of arms to support canvases or boards.

BRIEF DESCRIPTION OF THE DRAWINGS

In drawings which illustrate embodiments of the present invention.

DESCRIPTION OF THE PREFERRED EMBODIMENTS

Figure 1:
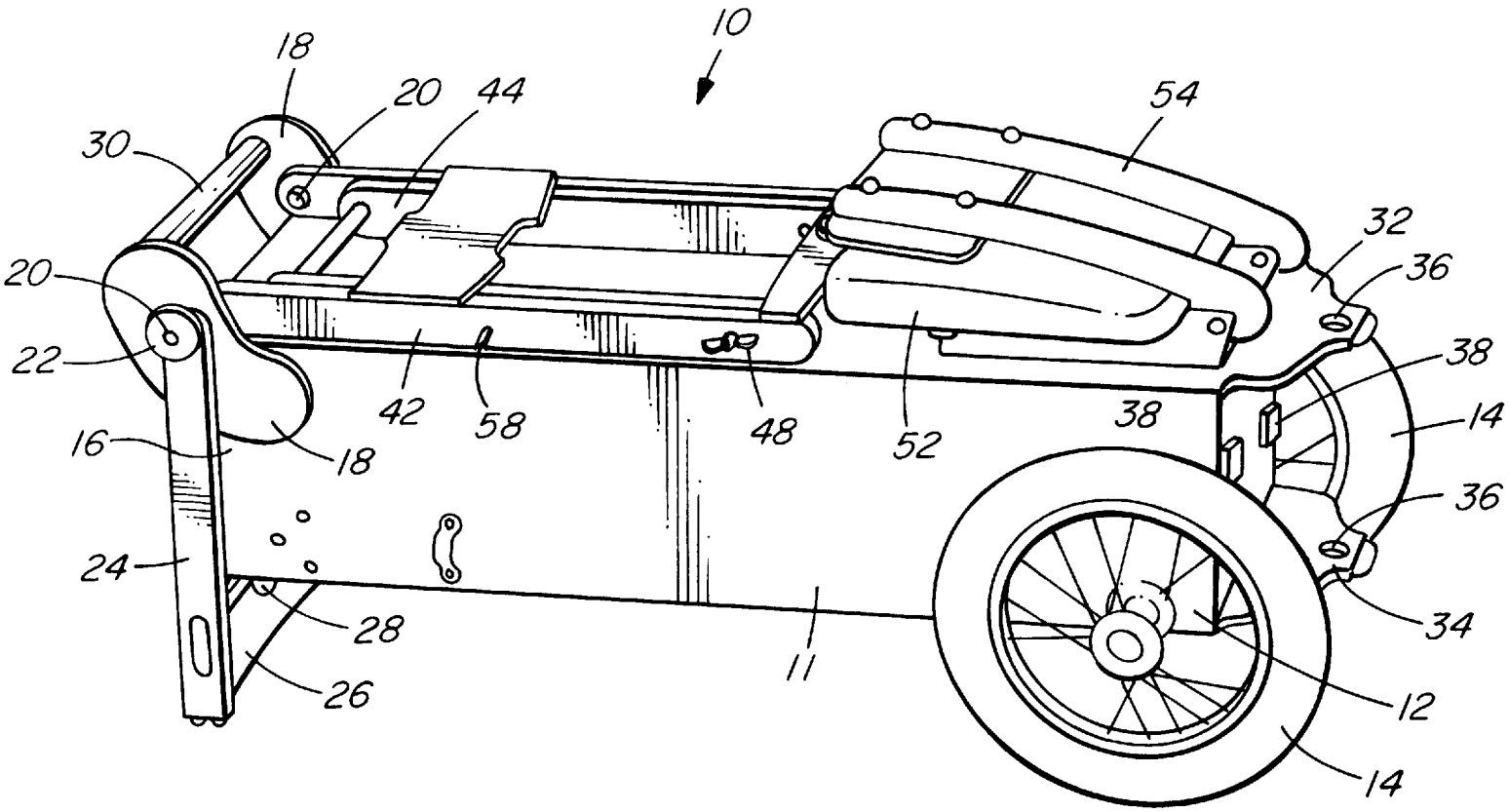
FIG. 1 is an isometric view showing a portable easel and seat assembly according to one embodiment of the present invention in a folded position.

Referring to FIG. 1, the portable easel and seat assembly 10 shows a substantially oblong box 11 which at the bottom rear corner 12 has wheels 14 mounted thereon. The wheels 14 are removable so that the box 11 can be placed in the trunk of a car. The wheels 14 are shown as being spoked wheels with pneumatic tires, thus they are lightweight and large enough to roll over rough ground without getting stuck.

At the top front corner 16 of the box 11 are two kidney-shaped plates 18 which extend frontward and upward from the front corner 16 and have a pivot pins 20 extending through each plate 18 just above the box 11. Threaded lock nuts 22 is provided on the pivot pins 20 and support legs 24 extend down on the outside of the plates 18 to the ground, the legs 24 and the wheels 14 supporting the box 11 so that it is substantially parallel to the ground or the floor that the assembly 10 rests on. The legs 24 have a cross member 26 which engages with a stop 28 on the bottom of the box 11, thus the legs 24 cannot fold back further than the lowered position as shown in FIG. 1. These legs 24 may be folded up about the pivot pins 20 so that they rest along the top of the box 11 as will be shown hereafter.

Figure 2:
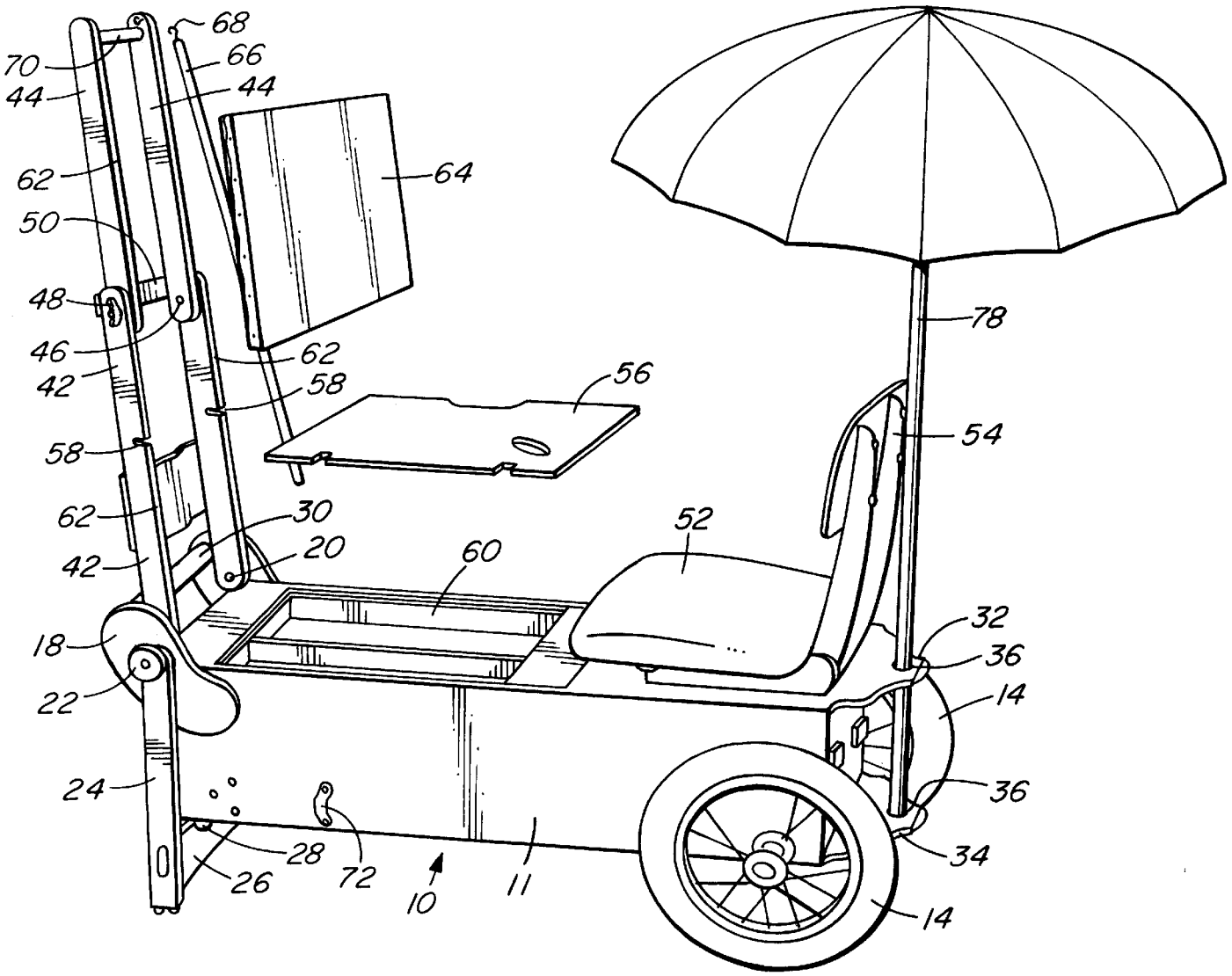
FIG. 2 is an isometric view showing the portable easel and assembly of FIG. 1 in the open position.

At the front end of the box 11, between the two kidney-shaped plates 18, is a handle crossbar 30 which can be used for wheeling the assembly 10 when in the folded position and also acts as a support for the easel as will be described. At the back of the box 11, behind the wheels 14, are top and bottom extension plates 32,34 with aligning holes 36 therein for an umbrella or sunshade to be supported as shown in FIG. 2. Reflectors 38 are shown positioned on the back end 40 of the box 11 for use when towed behind a bicycle. The back end 40 is pivotable downwards for access to a rear storage area to hold canvases and artists' materials.

As illustrated in FIGS. 1 and 2, the easel itself comprises two lower easel arms 42 which are connected at the base to the pivot pins 20 on the inside of the kidney-shaped plates 18. The lower arms 42 may be locked at any angle by tightening the lock nuts 22. When in the raised position, the lower arms 42 rest against the crossbar 30 and thus are supported in an upright position. Upper easel arms 44 have top pivot pins 46 with butterfly nuts 48 that hold the upper arms 44 in the extended position as shown in FIG. 2 resting against an upper cross piece 50 between the tops of the lower arms 42. When folded, as shown in FIG. 1, the upper arms 44 fold down inside the lower arms 42 which in turn fold down to rest on the top surface of the box 11.

A seat 52 is positioned on the box 11 over the wheels 14 and has a foldable backrest 54. The backrest is shown raised in FIG. 2 and folded down in FIG. 1.

A palette 56 is shown in FIG. 2 which may be handheld or, alternatively, fits into slots 58 positioned in front of the lower arms 42. The palette 56 fits over a tray 60 in the top of the box 11. The tray 60 can be used for containing paints and other artists' materials. The tray 60 is removable, and a compartment is provided underneath into which further artists' materials may be kept.

Mounting strips 62 extend along the front edge of the upper arms 44 and the lower arms 42. The mounting strips 62 may be made of a looped fibre fabric strip and mating strips formed of fabric with a plurality of hooked fibres, sold under the trade-mark VELCRO, may be attached to the canvases 64 or boards so that they may be attached at any position on the upper arms 44 and lower arms 42. It is noted that these arms 42,44 are in line, so the edges of the arms present a single plane for mounting the canvases 64 or boards.

A maul-stick 66 is shown in FIG. 2 with a hook 68 thereon. This hook 68 on the maul-stick 66 fits over a top cross piece 70 between the upper arms 44 or, alternatively, may be hooked onto one of the other cross pieces between the arms. The maul-stick 66 fits into the box 11 when the easel and seat assembly 10 are in the folded position.

Figure 3:
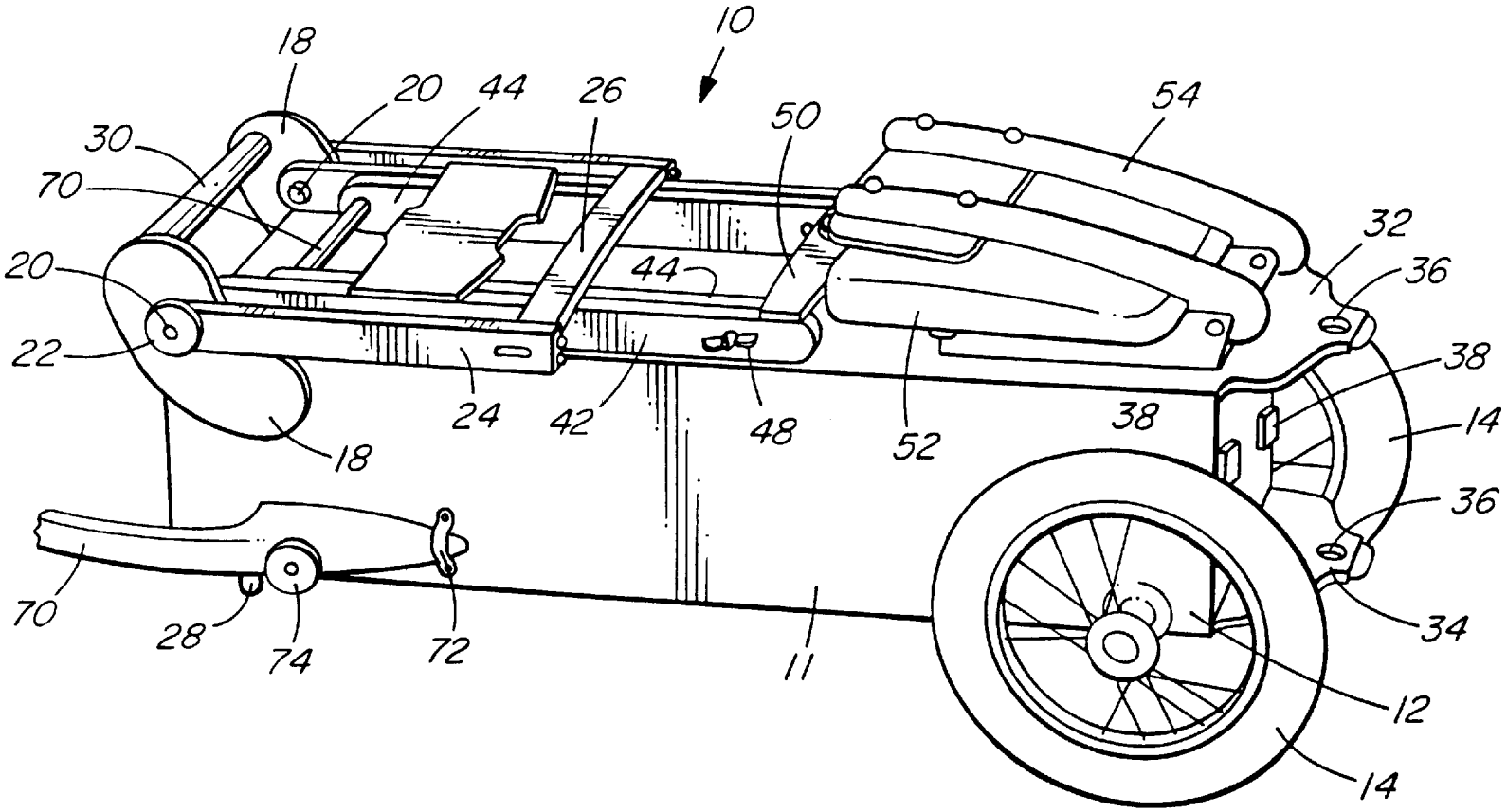
FIG. 3 is an isometric view showing the portable easel and seat assembly of FIG. 1 with elongated members attached to the front of the box for bicycle towing.

FIG. 3 illustrates the support legs 24 pivoted up into a folded position and resting on top of the box 11. The legs 24 are placed in this position for transporting the box and a single bicycle attachment arm 70 is shown fitting into a bracket 72 on one side of the box 11 with a holding screw 74 holding the attachment arm 70 in place.

Figure 4:
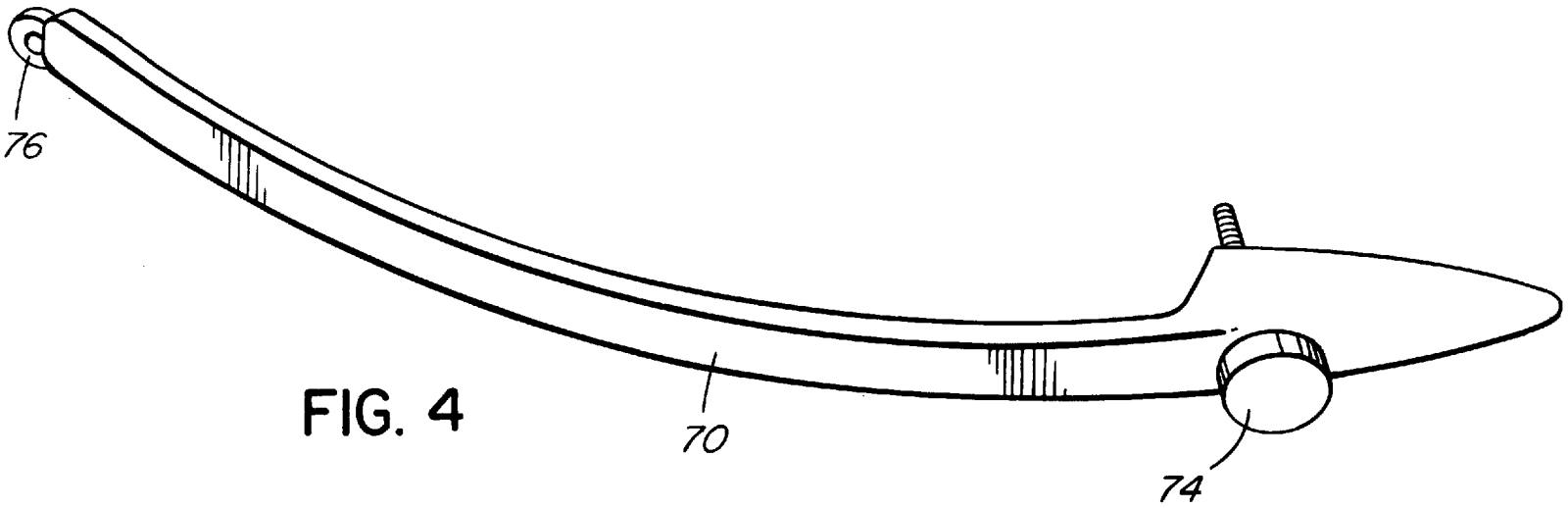
FIG. 4 is an isometric view showing the attachment arm for a bicycle.
Figure 5:
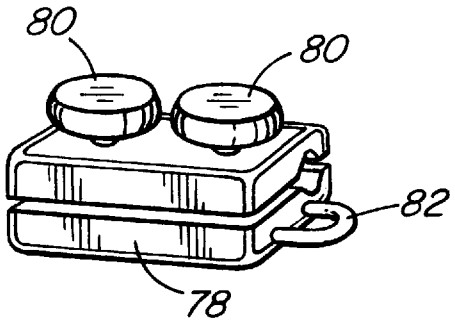
FIG. 5 is an isometric view showing a clamp for a bicycle for connecting the attachment arm shown in FIG. 4.

The bicycle attachment arm is shown in FIG. 4 which has a hook 76 at the extreme end. A clamp 78 is shown in FIG. 5 which clamps onto a rear frame member of a bicycle (not shown). Two clamp screws 80 hold the clamp 78 to the bicycle frame and a U-member 82 is attached to the back of the clamp 78, positioned so it is in the location of the rear axle of the bicycle. The hook 76 on the attachment arm 70 hooks over the U-member 82 on the clamp for towing. The attachment arm 70 can easily be unhooked when the easel and seat assembly is to be used or stored.

A sunshade or umbrella 78 is shown in FIG. 2. This is a standard umbrella which fits within the slots 36 of the two extended members 32 and 34.

The box 11, arms 42,44, bicycle attachment arm 70 and legs 24 are, in one embodiment, made of wood and are treated with a weather resistant finish so that the complete assembly 10 is not affected if it remains out in the rain. In one embodiment, the length of the box 11 is approximately 38" with a width of approximately 17" and a folded height of approximately 17".

In the embodiment shown, the weight of the assembly 10 with all components, but not including painting materials and canvases, amounts to 26 pounds which is not too heavy for an artist to push or pull to a site.

When the artist arrives at site, the assembly 10 is unfolded, the legs 24 are folded down, the lower arms 42 and the upper arms 44 are opened. The lower arms 42 and the legs 24 are locked in the required positions by the locking nuts 22 on the pivot pins 20. Whereas, in FIG. 2 the lower arms 42 are shown pushed back resting against the crossbar 30, it may not always be necessary to push them back as far as this. If desired, the upper arms 44 may be locked in a forward position so that they are almost vertical depending upon the requirement of the artist. The upper arms 44 are swivelled open and locked in place by the lock nuts 48. The seat back 54 is raised, the palette 56 is removed from its place on top of the tray 60 in the box 11 and a canvas 64 or board is positioned on the arms by use of the VELCRO strips 62. The upper arms 44 can also be swivelled to a substantially horizontal position, or slightly sloped towards the artist. The upper arms 44 are locked in place by the lock nuts 48. VELCRO strips are placed on the backs of the upper arms 44 so a canvas 64 can be positioned thereon. The artist's materials such as paints or colours may be assembled on the palette or remain in the tray 60 as shown in the top of the box 11 and the artist is then ready to commence painting. On hot days or rainy days an umbrella or sunshade may be provided as shown in FIG. 2.

At the end of painting it is simply necessary for the assembly 10 to be placed in the folded configuration. Canvases may be stored in the rear compartment at the back end 40, the top arms 44 and the bottom arms 42 are folded up, the seat back 54 is lowered, the legs 24 are also folded up. If the assembly 10 is to be towed behind a bicycle, then the attachment arm 70 is inserted into bracket 72 and locked in place. The clamp 78 is mounted on the bicycle frame, the attachment arm 70 hooked onto the clamp 78 and the portable easel and seat assembly 10 can then be moved. If a bicycle is not used, then the assembly 10 can be pulled along from the handle crossbar 30. If it is to be put in a car, then the wheels 14 may be removed.

Various changes may be made to the embodiments shown herein without departing from the scope of the present invention which is limited only by the following claims.

I claim:

1. A portable easel and seat assembly comprising:

a substantially oblong-shaped box having two wheels removably mounted at a rear end of a box, and two legs, pivoted from a pivot position at a front end of the box, the legs extending down to a locked lowered position, which together with the wheels, support the box in a plane substantially parallel to the ground;

a seat at the rear end of the box;

an easel frame with a first pair of substantially parallel arms linked together and with lower ends pivoted at the pivot position at the front end of the box, the first pair of arms supported in an upright position, and foldable to a first stored position on the top of the box, a second pair of substantially parallel arms, pivoted to upper ends of the first pair of arms, supported in an extended position substantially in line with the first pair of arms and foldable to a second stored position within the first pair of arms, and mounting strips on the first pair of arms and the second pair of arms to support canvases or boards.

2. The portable easel and seat assembly according to claim 1 wherein the legs have a folded position along the top of the box substantially parallel to the first pair of arms in the first stored position and the second pair of arms in the second stored position.

3. The portable easel and seat assembly according to claim 2 including a separate bicycle attachment arm for removably mounting on one side of the box when the legs are in the folded position for connecting to a bicycle to tow the assembly.

4. The portable easel and seat assembly according to claim 1 wherein the seat has a foldable backrest which when folded rests on the seat.

5. The portable easel and seat assembly according to claim 1 wherein the first pair of arms are supported in the upright position by a crossbar on the box behind the pivot position, the crossbar acting as a handle for the assembly when the easel arms are in the stored positions.

6. The portable easel and seat assembly according to claim 4 wherein the second pair of arms are supported in the extended position in line with the first pair of arms by a support piece between the first pair of arms.

7. The portable easel and seat assembly according to claim 6 including slots provided in the first pair of arms, the slots for supporting a palette.

8. The portable easel and seat assembly according to claim 1 wherein the mounting strips comprise first strips attached to the first pair of arms and the second pair of arms having looped fibres therein and second strips for attachment to canvases or boards having a plurality of hooked fibres to engage the looped fibres of the first strip.

9. The portable easel and seat assembly according to claim 1 including a removable palette as a cover to fit over a tray formed at the top of the box.

10. The portable easel and seat assembly according to claim 9 wherein the box has at least one compartment at the rear end for containing canvases, boards and artists' supplies.

11. The portable easel and seat assembly according to claim 1 including mounting holes provided at the end of the box in two extension members, the mounting holes for an umbrella or sunshade post.

12. The portable easel and seat assembly according to claim 1 including adjustable clamps for clamping the first pair of arms at the pivot position for locating the first/pair of arms between the upright position and the first stored position.

13. The portable easel and seat assembly according to claim 1 wherein the box, the legs and the easel frame are made of wood, the wood having a weather resistant finish thereon.

14. The portable easel and seat assembly according to claim 1 including a separate maul-stick having a hook at one end to hook over a top bar between the top of the second pair of arms, the maul-stick storable within the box.

* * * * *